US011988484B2

(12) United States Patent
Keller

(10) Patent No.: US 11,988,484 B2
(45) Date of Patent: May 21, 2024

(54) STORAGE COMPARTMENT FOR FIREARM GRIP

(71) Applicant: B5 Systems, Inc., Xenia, OH (US)

(72) Inventor: Mark J. Keller, Dayton, OH (US)

(73) Assignee: B5 Systems, Inc., Xenia, OH (US)

( * ) Notice: Subject to any disclaimer, the term of this patent is extended or adjusted under 35 U.S.C. 154(b) by 0 days.

(21) Appl. No.: 18/152,030

(22) Filed: Jan. 9, 2023

(65) Prior Publication Data

US 2023/0235990 A1 Jul. 27, 2023

Related U.S. Application Data

(60) Provisional application No. 63/266,601, filed on Jan. 10, 2022.

(51) Int. Cl.
*F41C 23/22* (2006.01)

(52) U.S. Cl.
CPC ..... *F41C 23/22* (2013.01)

(58) Field of Classification Search
CPC ..... F41C 23/22
See application file for complete search history.

(56) References Cited

U.S. PATENT DOCUMENTS 10,876,814 B1 * 12/2020 Visser ..... F41C 23/22
2011/0047850 A1 * 3/2011 Rievley ..... F41C 23/22 42/114
2019/0165343 A1 * 5/2019 Jernigan ..... H01M 50/247

* cited by examiner

*Primary Examiner* — J. Woodrow Eldred
(74) *Attorney, Agent, or Firm* — Eversheds Sutherland (US) LLP

(57) ABSTRACT

Storage plugs configured to receive batteries, tools, and/or accessories are provided. The storage plug includes an insert, insertable within a recess of a firearm grip, and one or more channels, each extending from a top surface of the insert. A wall disposed between indents extending from a bottom surface of the insert is configured to be held by a user during insertion or removal of the insert. One or more ridges disposed around the insert frictionally engage with an inner surface defining the recess of the firearm grip. Each channel is configured to receive one or more batteries, tools, and/or accessories. Each battery is one of a cylindrical battery, a square or rectangular battery, or a coin- or button-cell battery. Each tool is a multi-tool, a hex key, or another tool or accessory associated with a firearm or otherwise desirable to be carried in the storage plug.

20 Claims, 9 Drawing Sheets

STORAGE COMPARTMENT FOR FIREARM GRIP

CROSS-REFERENCE TO RELATED APPLICATION

This application is related to, and claims the benefit of, U.S. Provisional Patent Application No. 63/266,601, filed Jan. 10, 2022, the entire contents of which are incorporated herein by reference.

TECHNICAL FIELD

The present application generally relates to firearm grips.

BACKGROUND

As components of firearms, firearm grips are regularly exposed to demanding environmental and operational conditions. For example, firearm grips may need to withstand severe weather conditions (e.g., precipitation or moisture), heat (e.g., generated by discharge of the firearms), dirt, and/or impact (e.g., resulting from discharging or dropping the firearms).

Moreover, firearms are often associated with a need for batteries, tools, and/or accessories to provide functionality to the firearms and/or to maintain their operation. As such, it is desirable to carry such batteries, tools, and/or accessories when using the firearms. Firearm grips have been used to provide limited capability for the storage of batteries or other items, such as within recesses of the firearm grips. However, there is a need for improved storage capability associated with the grip of a firearm.

BRIEF DESCRIPTION OF THE DRAWINGS

These and other features, aspects, and advantages of the present invention will become apparent from the following description, the appended claims, and the accompanying exemplary embodiments shown in the drawings, which are briefly described below:

DETAILED DESCRIPTION

The present disclosure provides for a storage plug. The storage plug may include an insert, configured to be insertable within a recess of a firearm grip, and a plurality of channels. Each channel may extend from a top surface of the insert and be configured to receive one or more batteries, tools, and/or accessories to be held within the compact space of a firearm grip. Each of the one or more batteries, tools, and/or accessories may be of a similar or different type, with each channel having dimensions corresponding to those of the chosen batteries, tools, and/or accessories.

Figure 1:
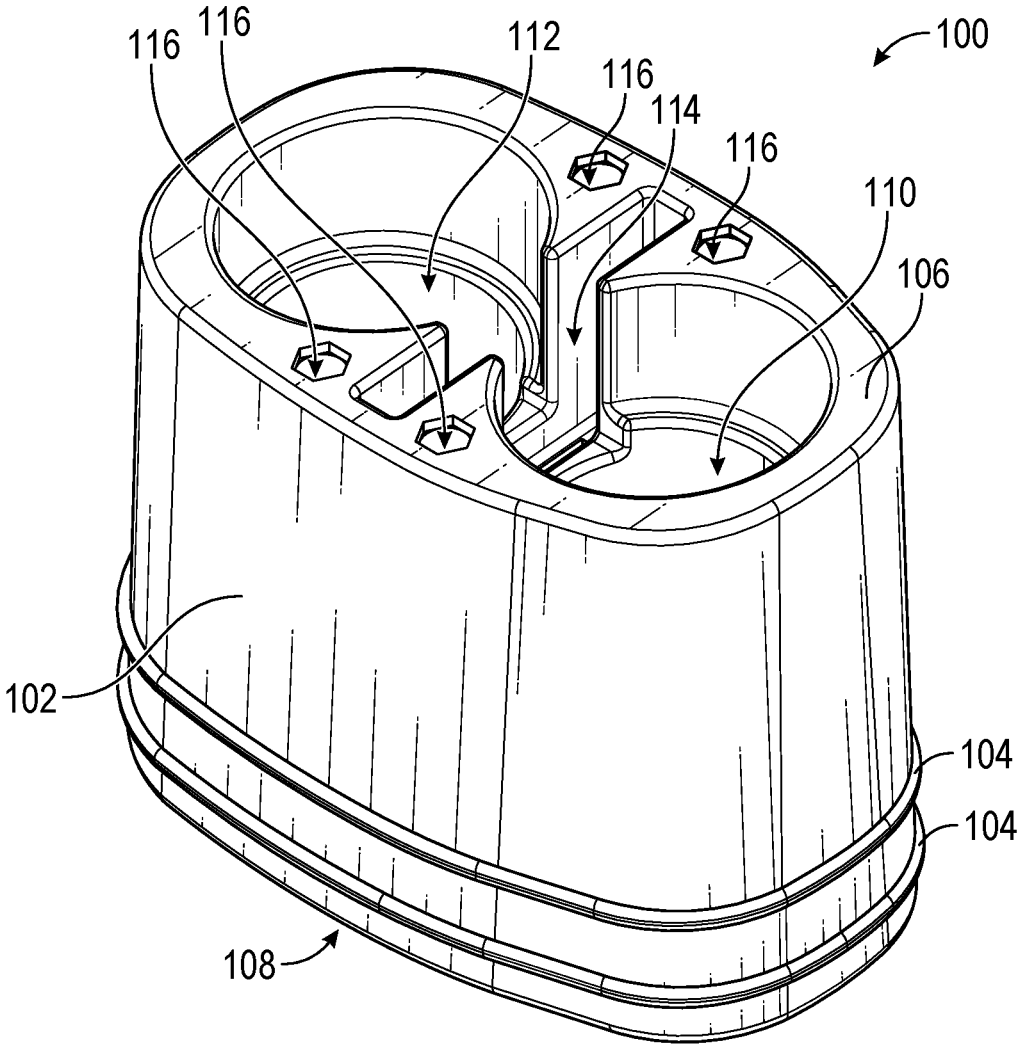
FIG. 1 is a perspective view of a storage plug in accordance with one or more exemplary embodiments of the disclosure.

Referring now to FIG. 1, and in brief overview, storage plug 100 may include insert 102, one or more ridge(s) 104, and one or more channel(s). The insert 102 may include top surface 106 and bottom surface 108. The insert 102 may be configured to be insertable within a recess of a firearm grip, such as recess 608 of firearm grip 602 illustrated in FIG. 6 (and further described below). The ridge(s) 104 may be disposed around the insert 102 and configured to engage, frictionally or otherwise, with one or more components of a firearm grip, such as inner surface 606 of grip wall(s) 604 or catch(es) 702 illustrated, respectively, in FIGS. 6 and 7A (and described in further detail below). The one or more channel(s) may include one or more of first channel 110, second channel 112, third channel 114, and one or more fourth channel(s) 116, each of which may be oriented perpendicularly or at an angle with respect to the top surface 106. For example, the first channel 110, the second channel 112, the third channel 114, and/or the fourth channel(s) 116 may extend into the insert 102 from top surface 106 toward bottom surface 108 at an angle corresponding to an angle of the firearm grip into which the insert 102 is to be inserted so as to facilitate storage of one or more batteries, tools, and/or accessories by the storage plug 100. In some embodiments, longitudinal axes of the channel(s) may be parallel or substantially parallel with an axis extending between the top surface 106 and the bottom surface 108 such that the channels are vertical or substantially vertical with respect to the insert 102 as oriented for insertion within the firearm grip.

In various embodiments, components of the storage plug 100 may be made of any material(s), including rubber, plastic, composite material(s), resin, or other suitable material(s). In some embodiments, the storage plug 100 may be formed from multiple pieces. In other embodiments, the storage plug 100 may be formed from a unitary piece.

Figure 2:
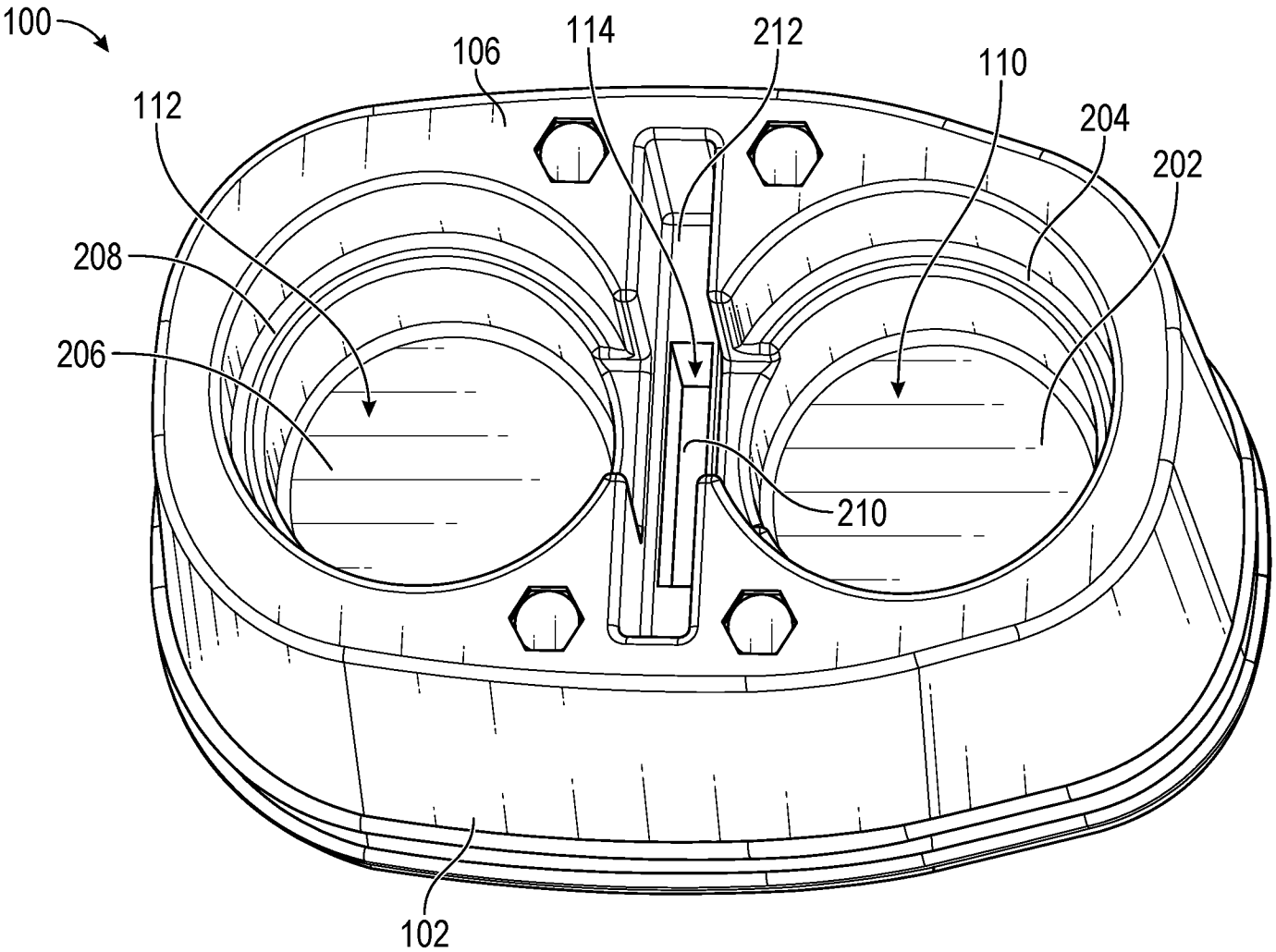
FIG. 2 is a perspective view of a storage plug in accordance with one or more exemplary embodiments of the disclosure.

Referring now to FIG. 2, and in brief overview, each channel of the storage plug 100 may be defined by a geometric profile extending from the top surface 106 of insert 102 to a base disposed within the insert 102. For example, the first channel 110 may be defined by a cylindrical profile extending from the top surface 106 to first base 202, the second channel 112 may be defined by a cylindrical profile extending from the top surface 106 to second base 206, and/or the third channel 114 may be defined by a slot profile extending from the top surface 106 to third base 210. Each channel may be further defined by a shelf disposed between the top surface 106 and the associated base. For example, the first channel 110 may be further defined by first shelf 204 disposed between the top surface 106 and the first base 202, the second channel 112 may be further defined by second shelf 208 disposed between the top surface 106 and the second base 206, and/or the third channel 114 may be further defined by third shelf 212 disposed between the top surface 106 and the third base 210. In some embodiments, the third channel 114 may be disposed between the first channel 110 and the second channel 112. In other embodiments, the third channel 114 may be disposed on either or both sides of first channel 110 and/or second channel 112, or may be otherwise disposed as suitable to fit within insert 102. It will, of course, be understood by those having skill in the art that the configuration of the first channel 110, the second channel 112, and the third channel 114 described herein with respect to FIG. 2 is merely exemplary and that numerous other channel configurations are envisioned by the present disclosure.

Figure 3A:
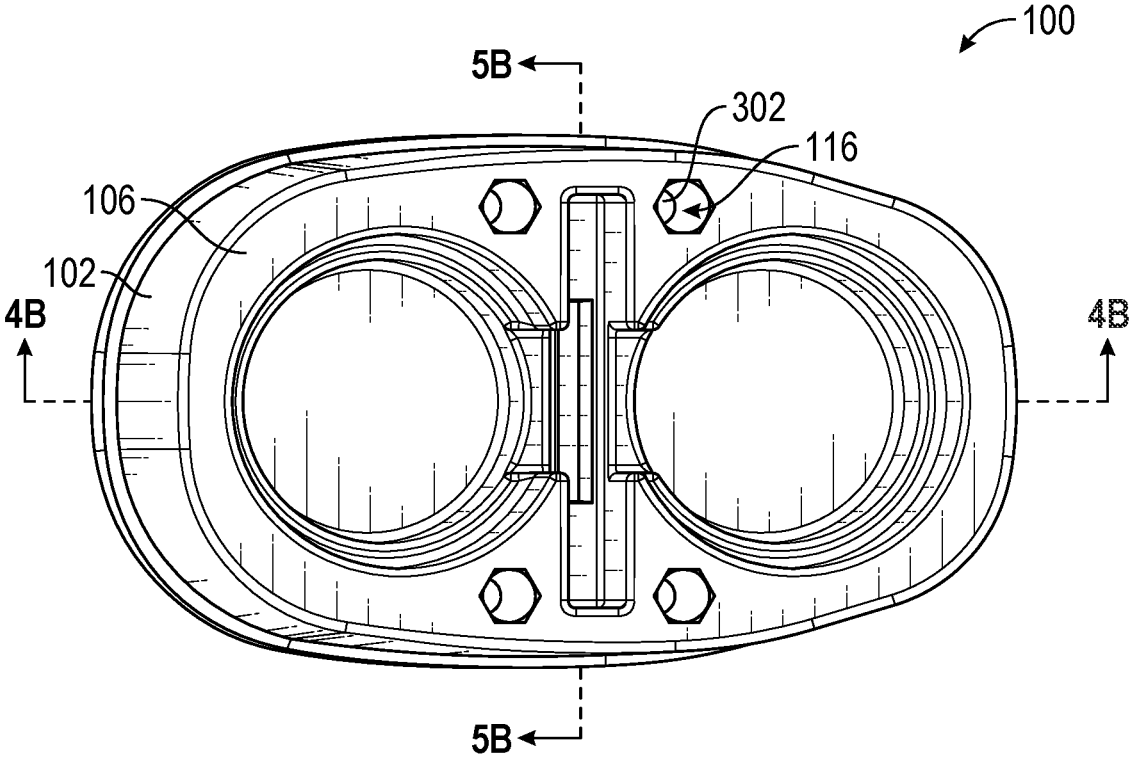
FIGS. 3A-3B are top and bottom views of a storage plug in accordance with one or more exemplary embodiments of the disclosure.
Figure 3B:
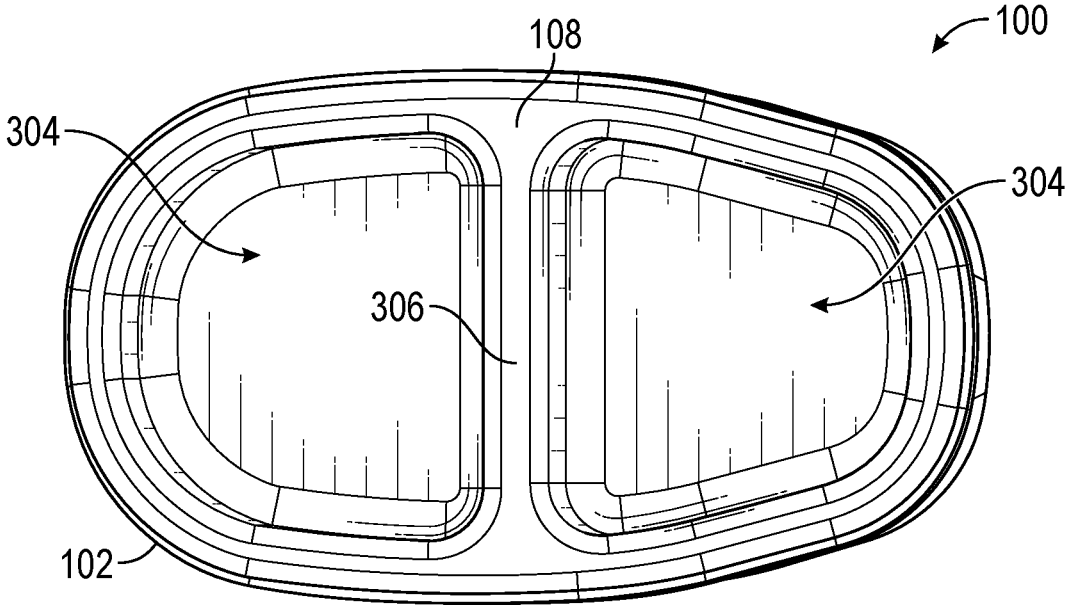

Referring now to FIGS. 3A-3B, and in brief overview, the storage plug 100 may include one or more features or components apparent from the top surface 106 and/or the bottom surface 108 of the insert 102.

As shown in FIG. 3A, for example, the fourth channel(s) 116 may each be defined by a similar or different geometric profile as compared to, for example, the first channel 110, the second channel 112, and/or the third channel 114 described above with respect to FIG. 2, and the geometric profile may extend from the top surface 106 of insert 102 to a base disposed within the insert 102. For example, the fourth channel(s) 116 may each be defined by a hexagonal profile extending from the top surface 106 to fourth base 302. Each fourth channel 116 may be configured to receive a first tool or accessory that rests on the fourth base 302. In some embodiments, for example, each fourth channel 116 may be configured to receive a hex key corresponding to the hexagonal profile described above. In other embodiments, the fourth channel(s) 116 may have varying size(s), dimension(s), and/or hexagonal profile(s) with respect to one another, such that each fourth channel 116 may be configured to receive a hex key differing in size from the hex key(s) that the other fourth channel(s) 116 may be configured to receive. In various embodiments, the fourth channel (s) 116 may be disposed about the first channel 110, the second channel 112, and the third channel 114. In certain embodiments, the inclusion and/or disposition of the fourth channel(s) 116 may prove beneficial during fabrication and/or handling of the storage plug 100, such as by preventing warping and/or stressing of the storage plug 100. It bears repeating, however, that the configuration of the first channel 110, the second channel 112, the third channel 114 and/or the fourth channel(s) 116 described herein with respect to one another is merely exemplary and that numerous other channel configurations are envisioned by the present disclosure.

As shown in FIG. 3B, the storage plug 100 may include at least one wall 306 disposed between a plurality of indent(s) 304 extending from the bottom surface 108 of the insert 102. The wall 306 may be configured to be held by a user (e.g., via gripping or pinching by hand) during insertion or removal of the insert 102 within or from a recess of a firearm grip, such as recess 608 of firearm grip 602 illustrated in FIG. 6 (and further described below).

Figure 4A:
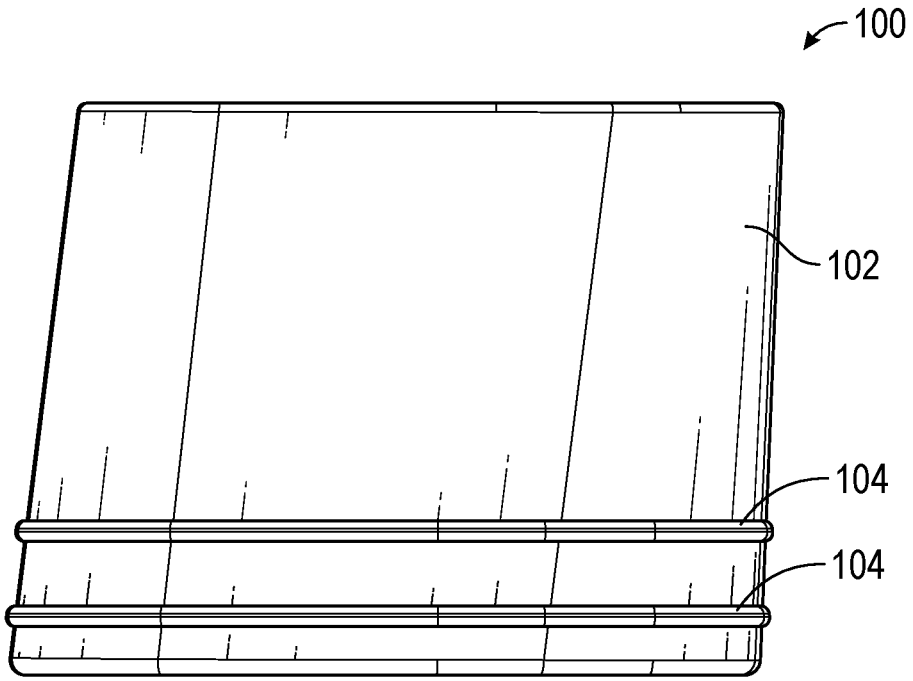
FIGS. 4A-4B are side and cross-sectional views of a storage plug in accordance with one or more exemplary embodiments of the disclosure.
Figure 4B:
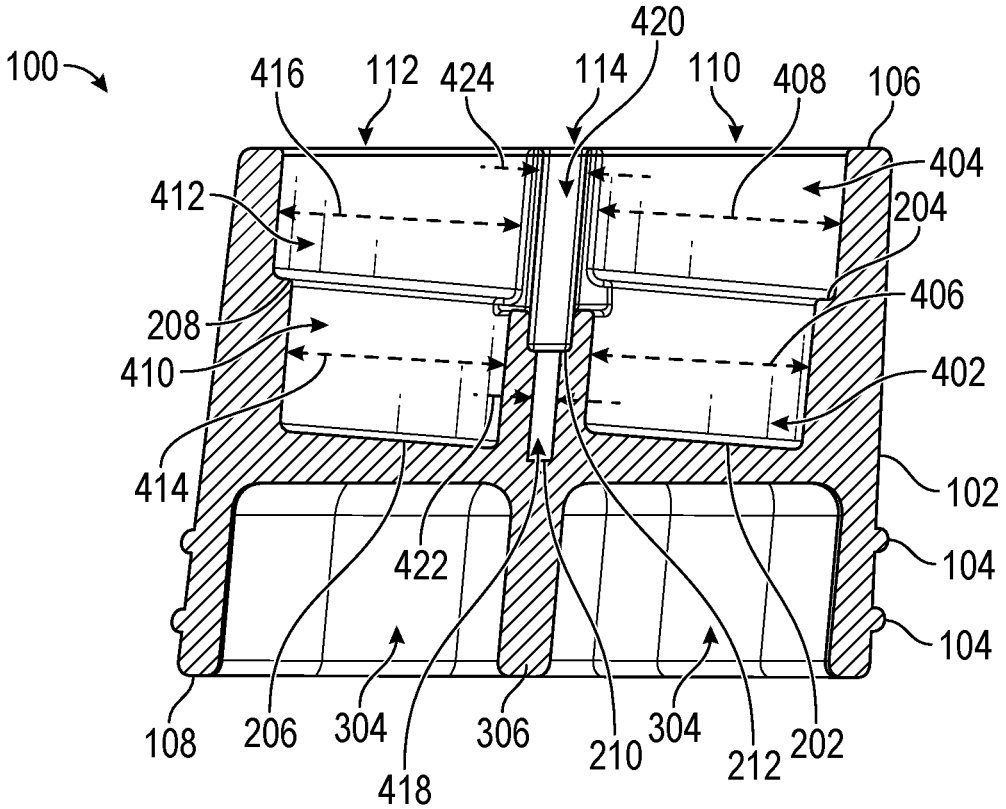

Referring now to FIGS. 4A-4B, and in brief overview, the storage plug 100 may include one or more features or components apparent from a side or cross-sectional view of the insert 102.

As shown in FIG. 4A, for example, the ridge(s) 104 may be disposed around the insert 102. The ridge(s) 104 may be made of any material, including rubber, plastic, composite material, resin, or another suitable material. The ridge(s) 104 may be configured to engage, frictionally or otherwise, with one or more components of a firearm grip during insertion of the insert 102 (as described in further detail below).

As shown in FIG. 4B (a cross-sectional view corresponding to cross-section 4B-4B illustrated in FIG. 3A), various dimensions may be associated with one or more channel(s) extending from the top surface 106 toward the bottom surface 108 of the insert 102. For example, the first channel 110 may be defined by a first cylindrical profile extending from the top surface 106 to the first base 202 and having first diameter 406 and/or by the first shelf 204 disposed between the top surface 106 and the first base 202 and having second diameter 408, which may be different from the first diameter 406. The first channel 110 may be divided into first section 402 and second section 404 by the first shelf 204. As such, the first channel 110, may be configured to receive batteries of the same or different sizes that rest on the first base 202 and/or the first shelf 204. In the present embodiment, for example, the first channel 110 may be configured to receive a first battery having a diameter approximately equal to the first diameter 406 that rests on the first base 202 and/or a second battery having a diameter approximately equal to the second diameter 408 that rests on the first shelf 204.

The second channel 112 may be defined by a second cylindrical profile extending from the top surface 106 to the second base 206 and having third diameter 414 and/or by the second shelf 208 disposed between the top surface 106 and the second base 206 and having fourth diameter 416, which may be different from the third diameter 414. The second channel 112 may be divided into third section 410 and fourth section 412 by the second shelf 208. As such, the second channel 112 may be configured to receive batteries of the same or different sizes that rest on the second base 206 and/or the second shelf 208. In the present embodiment, for example, the second channel 112 may be configured to receive a third battery having a diameter approximately equal to the third diameter 414 that rests on the second base 206 and/or a fourth battery having a diameter approximately equal to the fourth diameter 416 that rests on the second shelf 208.

The third channel 114 may be defined by a slot profile extending from the top surface 106 to the third base 210 and having a first width 422 and/or by the third shelf 212 disposed between the top surface 106 and the third base 210 and having second width 424, which may be different from the first width 422. The third channel 114 may be divided into fifth section 418 and sixth section 420 by the third shelf 212. As such, the third channel 114 may be configured to receive batteries, tools, and/or accessories of the same or different types or sizes that rest on the third base 210 and/or the third shelf 212. In the present embodiment, for example, the third channel 114 may be configured to receive a fifth battery and/or a second tool or accessory, each having a width or thickness approximately equal to the first width 422 or the second width 424. The fifth battery and/or the second tool or accessory may rest on the third base 210 and/or the third shelf 212. In some embodiments, the fifth battery and the second tool or accessory may both be received simultaneously within the third channel 114. In other embodiments, only the fifth battery or the second tool or accessory may be received within the third channel 114 at one time.

In various embodiments, the channel(s) may be configured to receive batteries, tools, and/or accessories of various types, sizes, and characteristics. For example, the first channel 110 and/or the second channel 112 may be configured to receive one or more cylindrical batteries such as disposable or rechargeable A, A23, A23, A27, 4/5 AA, AA, AAA, AAAA, B, Sub C, C, D, F, and/or N batteries. The third channel 114 may be configured to receive one or more lithium, silver oxide, and/or alkaline coin- or button cell-batteries (e.g. batteries having suitable SR designations), such as CR2032, CR927, CR1229, CR1225, CR2050, CR2450, CR2477, CR3032, and/or CR11108 lithium batteries. In some embodiments, one or more channel(s), such as the first channel 110 and/or the second channel 112, may be further defined by a rectangular cross-section to allow for the channel(s) to receive a greater variety of batteries. For example, the first channel 110 and/or the second channel 112 may be configured to receive one or more square or rectangular batteries, such as disposable or rechargeable 4.5 V, 6 V, and/or 9 V batteries, in addition to or instead of cylindrical batteries.

In various embodiments, first diameter 406, second diameter 408, third diameter 414, fourth diameter 416, first width 422, and second width 424 may be equal or different such that the same or different batteries, tools, and/or accessories may be received within each of the first channel 110, the second channel 112, and/or the third channel 114. It will, of course, be understood by those having skill in the art that numerous other dimensions and configurations of the channel(s) are further envisioned by the present disclosure.

The indent(s) 304 between which the wall 306 is disposed may extend from the bottom surface 108 of the insert 102 to a height below the base(s) of the channel(s) described above such that the indent(s) 304 do not intersect with any of the base(s). For example, in the present embodiment, the indent(s) 304 may not intersect with any of the first base 202, the second base 206, or the third base 210. As such, batteries, tools, and/or accessories may be received to the bases of the channels without falling through the indent(s) 304.

Figure 5B:
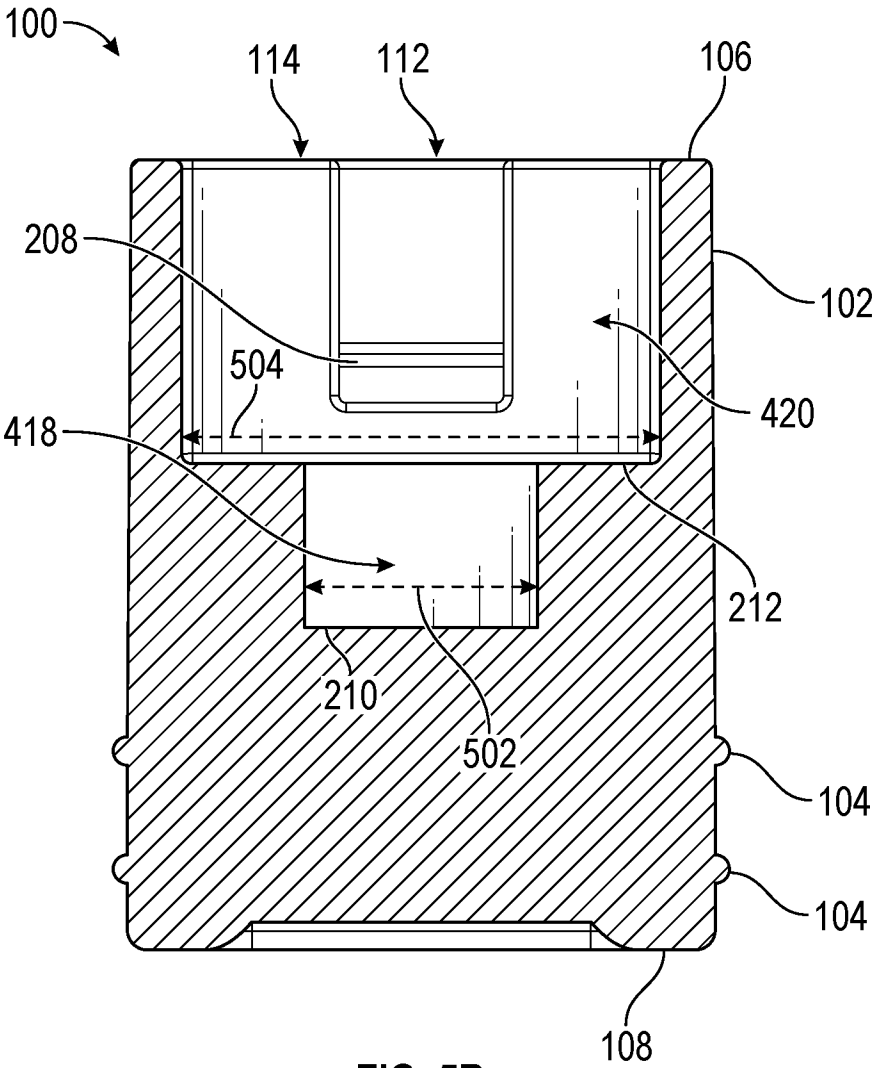
FIGS. 5A-5B are front and cross-sectional views of a storage plug in accordance with one or more exemplary embodiments of the disclosure.
Figure 5A:
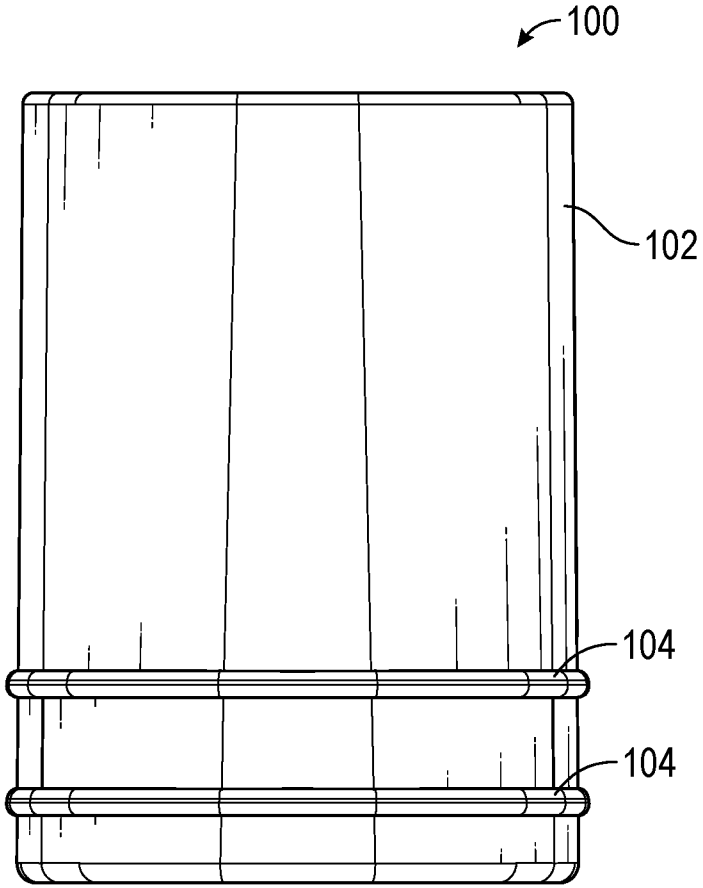

Referring now to FIGS. 5A-5B, and in brief overview, the storage plug 100 may include one or more features or components apparent from a front or cross-sectional view of the insert 102.

As shown in FIG. 5A, for example, the ridge(s) 104 may be disposed around the insert 102. As described above with respect to FIG. 4, the ridge(s) 104 may be configured to engage, frictionally or otherwise, with one or more components of a firearm grip during insertion of the insert 102.

As shown in FIG. 5B (a cross-sectional view corresponding to cross-section 5B-5B illustrated in FIG. 3A), various dimensions may be associated with one or more channel(s) extending from the top surface 106 toward the bottom surface 108 of the insert 102. For example, the slot profile defining the third channel 114 may further have first length 502, which may be the same as or different from first width 422 illustrated in FIG. 4B, and/or the third shelf 212 may further have second length 504, which may be the same as or different from second width 424 illustrated in FIG. 4B. As such, the dimensions of the batteries, tools, and/or accessories receivable within the third channel 114 may be further defined. In the present embodiment, for example, the third channel 114 may be further configured to receive a fifth battery and/or a second tool or accessory having a length or thickness approximately equal to the first length 502 or the second length 504 within the fifth section 418 and/or the sixth section 420.

The sections of the channel(s) may be oriented at the same or different depths with respect to the top surface 106 and to one another. For example, as illustrated by the present embodiment, the second shelf 208 of the second channel 112 may be disposed at a lesser distance from the top surface 106 than are the third base 210 or the third shelf 112 of the third channel 114.

Figure 6:
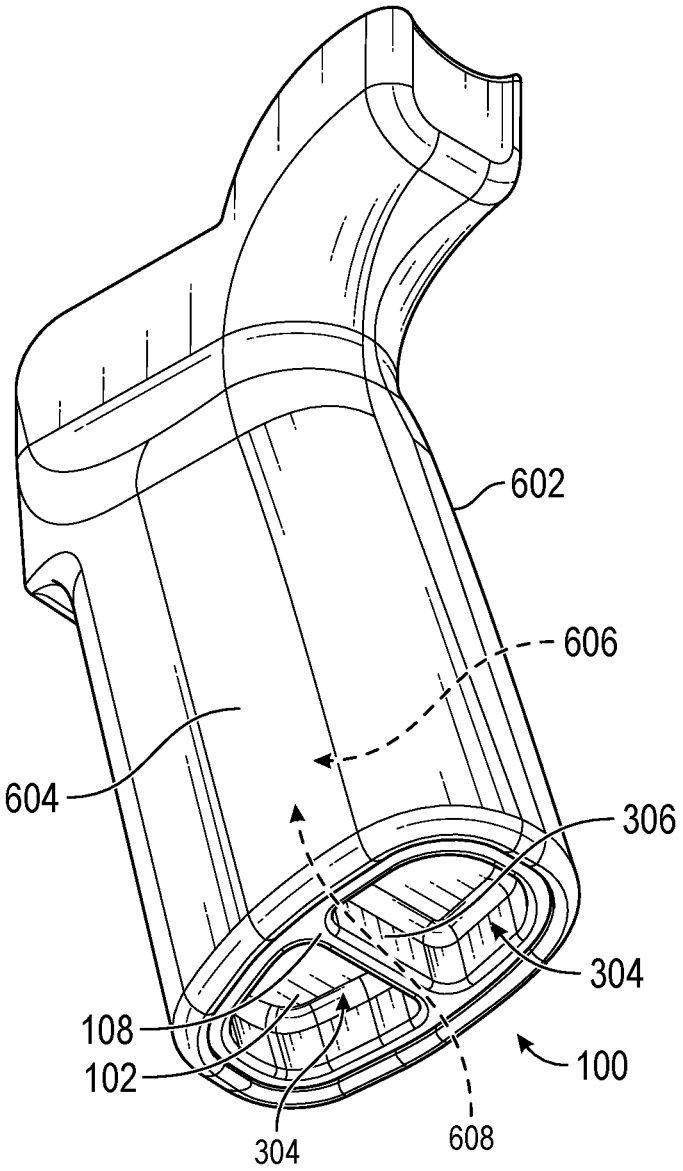
FIG. 6 is a perspective view of a storage plug, inserted within a firearm grip, in accordance with one or more exemplary embodiments of the disclosure.

Referring now to FIG. 6, and in brief overview, the storage plug 100 may be insertable within firearm grip 602. In the present embodiment, for example, the insert 102 of the storage plug 100 has been inserted into the firearm grip 602.

The firearm grip 602 illustrated herein is a component of a handgun. It will be understood, however, that the firearm grip 602 may be a component of any firearm, such as any long gun, shotgun, rifle, or other suitable firearm that includes a grip. The firearm grip 602 may include one or more grip wall(s) 604 and recess 608 disposed within the grip wall(s) 604. The recess 608 may be defined by inner surface 606 of the grip wall(s) 604.

The insert 102 may be any shape or configuration suitable for insertion within a recess of a firearm grip, such as the recess 608 of the firearm grip 602. The shape, size, angle, and/or orientation of the insert 102 may vary depending on the firearm grip 602 into which the insert 102 is to be inserted. For example, the insert 102 may define a tapered or angled profile corresponding to the recess 608. As illustrated in the present embodiment, the insert 102 may be trapezoidal. However, numerous other suitable shapes, sizes, angles, and/or orientations of the insert 102 are envisioned by the present disclosure.

In the present embodiment, a user may insert the insert 102 into the recess 608 by, for example, gripping the wall 306 disposed between the indent(s) 304. In other embodiments, the user may insert the insert 102 into the recess 608 by other means, including by hand or by using a tool Similar or different means may be employed by the user to remove the insert 102 from the recess 608. In various embodiments, the bottom surface 108 of the insert 102 may rest flush or substantially flush with the grip wall(s) 604 when the insert 102 is inserted within the recess 608 and may rest at a different location when the insert 102 is removed from the recess 608.

Figure 7A:
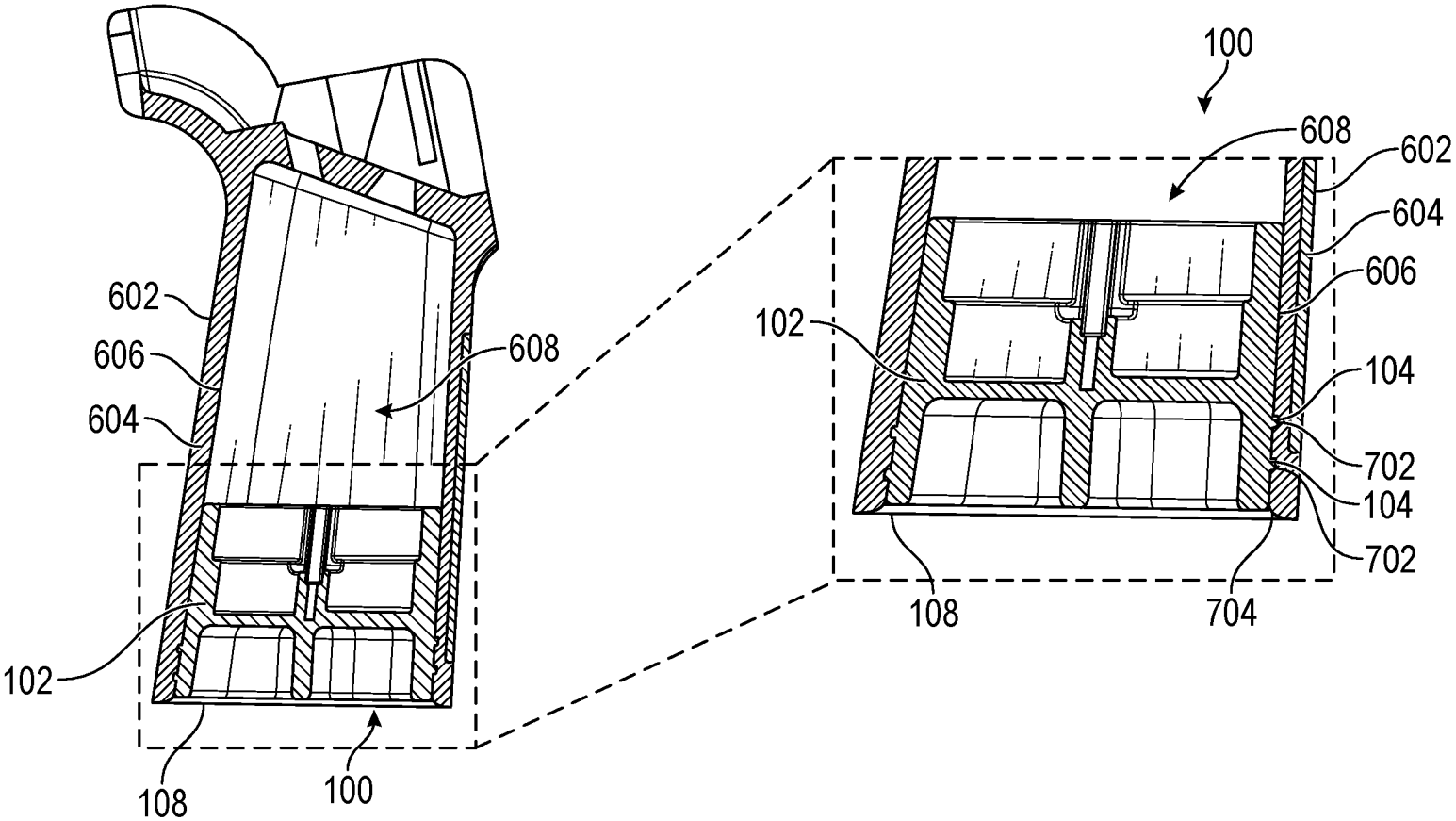
FIGS. 7A-7C are cross-sectional views of a storage plug, inserted within a firearm grip and holding batteries, in accordance with one or more exemplary embodiments of the disclosure.
Figure 7C:
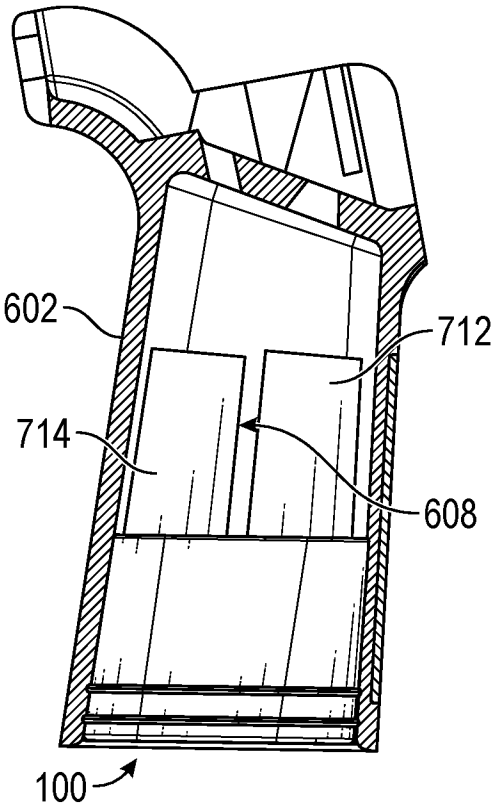
Figure 7B:
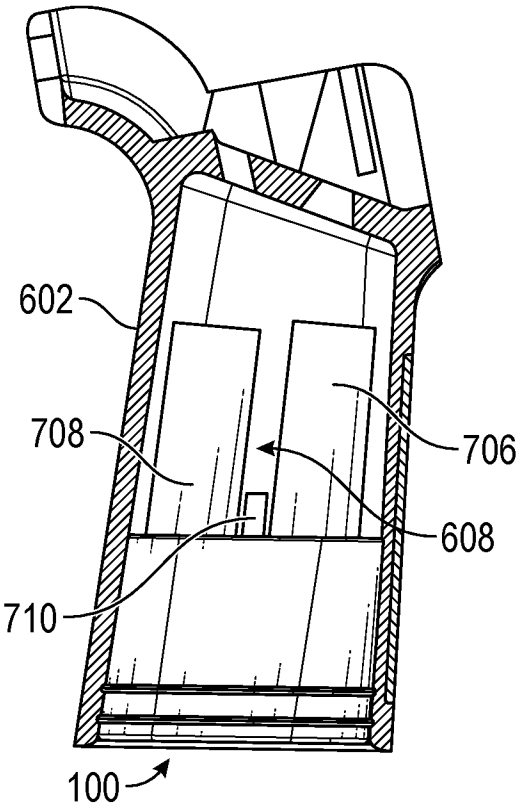

Referring now to FIGS. 7A-7C, and in brief overview, the storage plug 100 may be inserted within the firearm grip 602. One or more component(s) of the storage plug 100 may be configured to engage with one or more component(s) of the firearm grip 602. While inserted within the firearm grip 602, the storage plug 100 may be configured to hold one or more batteries, tools, and/or accessories in a secure manner.

As shown in FIG. 7A, the insert 102 may include the ridge(s) 104 and/or flange 704, which may be configured to secure the storage plug 100 within the firearm grip 602. In some embodiments, for example, the ridge(s) 104 may be disposed around the insert 102 and may be configured to frictionally engage with the inner surface 606 of the grip wall(s) 604 defining the recess 608 of the firearm grip 602. In other embodiments, the ridge(s) 104 may be configured to engage with one or more catch(es) 702 disposed around the inner surface 606 of the grip wall(s) 604. The ridge(s) 104 and/or catch(es) 702 may be made of a flexible material such that the flexure of the material allows the ridge(s) 104 to engage and disengage with the catch(es) 702 when sufficient force is applied, such as by a user. In various embodiments, the ridge(s) 104 may be further configured to form a watertight seal with the inner surface 606 between the recess 608 of the firearm grip 602 and an external environment. As such, any batteries, tools, or accessories held by the storage plug 100 may be protected from elements such as precipitation, moisture, or dirt when the insert 102 is inserted within the recess 608.

The storage plug 100 may be insertable within the firearm grip in one or more fixed orientations. For example, the storage plug 100 may include an extension (e.g., flange 704), which may be configured to restrict insertion of the insert 102 to a fixed depth within the recess 608 by engaging with one or more component(s) of the firearm grip 602. In some embodiments, the flange 704 may be disposed around or substantially around the bottom surface 108 of the insert 102. When the insert 102 is inserted within the recess 608, the flange 704 may engage with the grip wall(s) 604 (e.g., at a butt of the grip wall(s) 604), thereby preventing over-insertion of the storage plug 100 within the firearm grip 602. Accordingly, the bottom surface 108 of the insert 102 may rest flush or substantially flush with the grip wall(s) 604.

As shown in FIGS. 7B-7C, the storage plug 100 may be configured to hold one or more batteries, tools, and/or accessories when inserted within the firearm grip 602. For example, as shown in FIG. 7B, the storage plug 100 may hold first battery 706, second battery 708, and/or third battery 710 within the recess 608 of the firearm grip 602. Alternatively, as shown in FIG. 7C, the storage plug 100 may hold fourth battery 712 and/or fifth battery 714. It will be understood by those having skill in the art that the first battery 706, the second battery 708, the third battery 710, the fourth battery 712, and/or the fifth battery 714 may be the same or different types of batteries having the same or different dimensions as one another.

Figure 8:
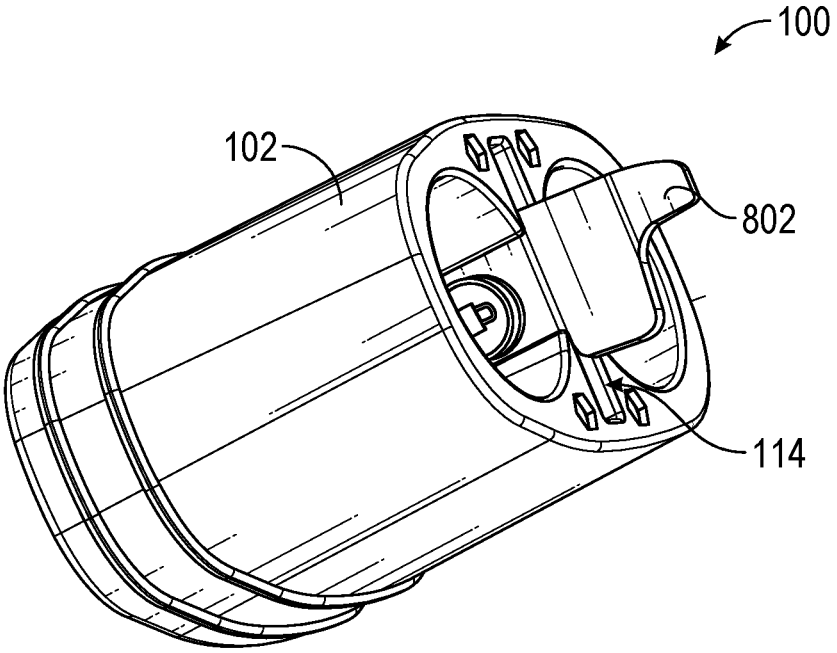
FIG. 8 is a perspective view of a storage plug, holding a multi-tool, in accordance with one or more exemplary embodiments of the disclosure.

Referring now to FIG. 8, and in brief overview, the storage plug 100 may be configured to hold one or more tools and/or accessories. For example, the third channel 114 may be configured to receive tool or accessory 802. Tool or accessory 802 may be any tool or accessory, such as a tool or accessory associated with a firearm or otherwise desirable to be carried in the storage plug 100. In some embodiments, the tool or accessory 802 may be a multi-tool. In other embodiments, the tool or accessory 802 may be a key-ring accessory. In the present embodiment, for illustrative purposes, the tool or accessory 802 is a multi-tool including a firearm turret adjuster, a screwdriver, one or more dovetails, an index extrusion, and a lanyard hole, such as the NANO® Micro Multi-tool manufactured by Multitasker Tools, LLC. It will, however, be understood by those having skill in the art that the tool or accessory 802 may be any one of numerous suitable tools or accessories.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A storage plug, comprising:

an insert configured to be insertable within a recess of a firearm grip; and a plurality of channels, each channel extending from a top surface of the insert and configured to receive one or more batteries, tools, and/or accessories, the plurality of channels comprising:

a first channel, extending to a first base, defined by a first cylindrical profile having at least a first diameter, further defined by a first shelf disposed between the top surface and the first base and having a second diameter different from the first diameter, and configured to receive at least one of a first battery that rests on the first base and a second battery that rests on the first shelf; and a second channel, extending to a second base, defined by a second cylindrical profile having at least a third diameter, further defined by a second shelf disposed between the top surface and the second base and having a fourth diameter different from the third diameter, and configured to receive at least one of a third battery that rests on the second base and a fourth battery that rests on the second shelf.

2. The storage plug of claim 1, wherein the first battery and the third battery are each a first type of battery, and wherein the second battery and the fourth battery are each a second type of battery.

3. The storage plug of claim 1, wherein the first battery, the second battery, the third battery, and the fourth battery include two or more different types of batteries.

4. The storage plug of claim 1, wherein at least one of the first battery, the second battery, the third battery, and the fourth battery is a type-A battery, a type-A23 battery, a type-A27 battery, a type-4/5 AA battery, a type-AA battery, a type-AAA battery, a type-AAAA battery, a type-B battery, a type-Sub C battery, a type-C battery, a type-D battery, a type-F battery, a type-N battery, or a different cylindrical battery.

5. The storage plug of claim 1, wherein at least one of the first channel and the second channel is further defined by a rectangular cross-section, and wherein at least one of the first battery, the second battery, the third battery, and the fourth battery is a type-4.5 V battery, a type-6 V battery, a type-9 V battery, or a different square or rectangular battery.

6. The storage plug of claim 1, wherein the plurality of channels further comprise a third channel, the third channel defined by a slot profile having at least a first length and a first width, extending to a third base, disposed between the first channel and the second channel, and configured to receive at least a fifth battery that rests on the third base or the third shelf.

7. The storage plug of claim 6, wherein the fifth battery is a type-CR2032 lithium battery, a type-CR927 lithium battery, a type-CR1229 lithium battery, a type-CR1225 lithium battery, a type-CR2050 lithium battery, a type-CR2450 lithium battery, a type-CR2477 lithium battery, a type-CR3032 lithium battery, a type-CR11108 lithium battery, or a different lithium, silver oxide, or alkaline coin- or button-cell battery.

8. The storage plug of claim 6, wherein the third channel is further defined by a third shelf disposed between the top surface and the third base and having at least a second length different from the first length and/or a second width different from the first width, the third channel further configured to receive a first tool or accessory that rests on the third base or the third shelf.

9. The storage plug of claim 8, wherein the first tool or accessory is a multi-tool.

10. The storage plug of claim 6, wherein the plurality of channels further comprise one or more fourth channels, each fourth channel extending from the top surface to a fourth base, disposed about the first channel, the second channel, and the third channel, and configured to receive a second tool or accessory that rests on the fourth base.

11. The storage plug of claim 10, wherein each fourth channel is defined by a hexagonal profile, and wherein the second tool or accessory is a hex key.

12. The storage plug of claim 1, further comprising at least one wall disposed between a plurality of indents extending from a bottom surface of the insert, the at least one wall configured to be held by a user during insertion or removal of the insert within or from the recess of the firearm grip.

13. The storage plug of claim 12, further comprising one or more ridges disposed around the insert and configured to frictionally engage with an inner surface defining the recess of the firearm grip.

14. The storage plug of claim 13, wherein the one or more ridges are further configured to engage with one or more catches disposed around the inner surface.

15. The storage plug of claim 13, wherein the one or more ridges are further configured to form a watertight seal with the inner surface between the recess of the firearm grip and an external environment.

16. The storage plug of claim 12, further comprising an extension or flange configured to restrict insertion of the insert to a fixed depth within the recess of the firearm grip by engaging with a butt of the firearm grip.

17. The storage plug of claim 1, wherein the insert defines a tapered or angled profile corresponding to the recess of the firearm grip.

18. The storage plug of claim 1, wherein the storage plug is formed from a unitary piece.

19. A storage plug, comprising:

an insert, configured to be insertable within a recess of a firearm grip, the insert defining a tapered or angled profile corresponding to the recess;

a wall, disposed between a plurality of indents extending from a bottom surface of the insert, the wall configured to be held by a user during insertion or removal of the insert within or from the recess;

one or more ridges, disposed around the insert, configured to frictionally engage with an inner surface defining the recess and/or engage with one or more catches disposed around the inner surface such that the one or more ridges form a watertight seal with the inner surface between the recess and an external environment;

a first channel, extending from a top surface of the insert to a first base, defined by two or more of a first cylindrical profile having a first diameter, a first shelf having a second diameter different from the first diameter, and a first rectangular cross-section, the first shelf disposed between the top surface and the first base, the first channel configured to receive at least one of a first battery that rests on the first base and a second battery that rests on the first shelf;

a second channel, extending from the top surface to a second base, defined by a second cylindrical profile having a third diameter and a second shelf having a fourth diameter different from the third diameter, the second shelf disposed between the top surface and the second base, the second channel configured to receive at least one of a third battery that rests on the second base and a fourth battery that rests on the second shelf;

a third channel, disposed between the first channel and the second channel, extending from the top surface to a third base, defined by a slot profile having a first length and a first width and a third shelf having a second length different from the first length and a second width different from the first width, the third shelf disposed between the top surface and the third base, the third channel configured to receive at least one of a first tool or accessory and a fifth battery that each rest on one of the third base or the third shelf; and one or more fourth channels, disposed about the first channel, the second channel, and the third channel, each fourth channel extending from the top surface to a fourth base, defined by a hexagonal profile, and configured to receive a second tool or accessory that rests on the fourth base, wherein the storage plug is formed from a unitary piece, wherein the first battery, the second battery, the third battery, and the fourth battery are each one of a type-A battery, a type-A23 battery, a type-A27 battery, a type-4/5 AA battery, a type-AA battery, a type-AAA battery, a type-AAAA battery, a type-B battery, a type-Sub C battery, a type-C battery, a type-D battery, a type-F battery, a type-N battery, a different cylindrical battery, a type-4.5 V battery, a type-6 V battery, a type-9 V battery, or a different square or rectangular battery, wherein the first tool or accessory is a multi-tool, wherein the fifth battery is one of a type-CR2032 lithium battery, a type-CR927 lithium battery, a type-CR1229 lithium battery, a type-CR1225 lithium battery, a type-CR2050 lithium battery, a type-CR2450 lithium battery, a type-CR2477 lithium battery, a type-CR3032 lithium battery, a type-CR11108 lithium battery, or a different lithium, silver oxide, or alkaline coin- or button-cell battery, and wherein the second tool or accessory is a hex key.

20. The storage plug of claim 19, further comprising an extension or flange, disposed around the bottom surface of the insert, configured to restrict insertion of the insert to a fixed depth within the recess of the firearm grip by engaging with a butt of the firearm grip.

* * * * *